US008857916B2

(12) United States Patent
Whitley et al.

(10) Patent No.: US 8,857,916 B2
(45) Date of Patent: Oct. 14, 2014

(54) HIGHWALL MINING EQUIPMENT RETRIEVAL AND EXTRACTION APPARATUS AND METHOD

(71) Applicant: Highwall Mining Solutions and Repair, LLC, Summersville, WV (US)

(72) Inventors: Ralph Whitley, Huntersville, NC (US); Dave Bundy, Summersville, WV (US)

(73) Assignee: Highwall Mining Innovations, LLC, Summerville, WV (US)

( * ) Notice: Subject to any disclaimer, the term of this patent is extended or adjusted under 35 U.S.C. 154(b) by 13 days.

(21) Appl. No.: 13/841,090

(22) Filed: Mar. 15, 2013

(65) Prior Publication Data

US 2014/0265521 A1 Sep. 18, 2014

(51) Int. Cl.
*E21C 29/04* (2006.01)
*E21F 17/00* (2006.01)

(52) U.S. Cl.
CPC ..... *E21F 17/00* (2013.01)
USPC ..... 299/30; 299/95

(58) Field of Classification Search
CPC ..... E21C 29/00; E21C 29/04
USPC ..... 299/10, 30, 95; 254/134 FT, 134.4, 254/134.3 R
See application file for complete search history.

(56) References Cited

U.S. PATENT DOCUMENTS

| | | | | |
|---|---|---|---|---|
| 2,826,402 | A | 3/1958 | Alspaugh et al. | |
| 4,192,551 | A | 3/1980 | Weimer et al. | |
| 4,281,876 | A | 8/1981 | Lansberry | |
| 4,323,280 | A | 4/1982 | Lansberry et al. | |
| 4,869,358 | A * | 9/1989 | Chandler | 299/11 |
| 4,898,496 | A * | 2/1990 | Pfeiffer et al. | 299/31 |
| 5,582,465 | A * | 12/1996 | Mraz | 299/18 |
| 6,109,699 | A * | 8/2000 | Mraz | 299/10 |
| 7,594,702 | B2 * | 9/2009 | Lowery | 299/64 |
| 2006/0038438 | A1 * | 2/2006 | Mraz | 299/30 |
| 2013/0049435 | A1 | 2/2013 | Graham | |
| 2013/0104768 | A1 | 5/2013 | Graham | |

OTHER PUBLICATIONS

Clyde AMCA International, hydraulic linear winches for continuous and intermittent duty, pp. 1-4, Clyde Amca International, Duluth, MN, US.

Lucker Manufacturing Cable Grip Equipment, Model No. 29 Heavy Duty Cable Grip, pp. 1-5.

* cited by examiner

*Primary Examiner* — John Kreck
(74) *Attorney, Agent, or Firm* — Myers Bigel Sibley & Sajovec, PA

(57) ABSTRACT

A highwall mining equipment extraction and retrieval apparatus and method is disclosed. It includes remotely operable hydraulic cylinders fixed to the mining head and stabilizing arms which brace the mining platform against the face of a mine. Wire ropes extend from hydraulic cylinders, through channels in the pushbeams, through lockable blocks fixed to the mining platform, and onto storage spools. The hydraulic cylinders operate from an extended to a retracted position. When a mine collapse occurs, an operator can remotely actuate the lockable blocks and the hydraulic cylinders, thereby locking the wire rope to the platform and pulling the mining head and pushbeams towards the platform. If the obstruction remains, the locking blocks can be unlocked, the hydraulic cylinders extended from the retracted position, the excess wire rope pulled from the mine, and the process can then be repeated until the equipment is free from the obstruction.

20 Claims, 7 Drawing Sheets

HIGHWALL MINING EQUIPMENT RETRIEVAL AND EXTRACTION APPARATUS AND METHOD

TECHNICAL FIELD AND BACKGROUND OF THE INVENTION

The present invention relates to the field of mining equipment and particularly to the field of highwall mining equipment. The invention is an apparatus designed to facilitate the retrieval of mining equipment, particularly highwall mining equipment, which has become trapped or otherwise lodged within a mine.

Since ancient times, humans have dug mines into the ground and into the sides of mountains in search of ore, minerals, metals, fuel, and other resources which are scarce on the surface. Likewise, since ancient times, among the dangers concurrent with the field of mining is the risk of the collapse of the mine. As miners dig into the ground or mountain, they extract rock and soil leaving behind a void. As the material surrounding the void shifts and settles, there is an inherent danger that the mine will collapse filling the void with debris. Since ancient times through to the present, miners have been trapped, injured, and killed in such collapses. In order to avoid such dangers to miners who enter the voids created by mining, it is desirable to conduct mining operations by way of mechanical mining controlled remotely from the surface.

One such mining operation where mining is accomplished via mechanical mining equipment controlled from outside the mining void is highwall mining. Highwall mining is especially useful in the mining of coal. In highwall mining, various imaging and sensing systems detect and map a seam of coal located within the ground, a mountain, or a hill. A "wall" is prepared on the mountainside or hillside or on a wall of a prepared trench that is substantially vertical to the horizontal and located near a beginning point of the coal seam. Typically, a large mining head cuts into and penetrates the mountain and coal seam. A pushbeam transfer mechanism pushes the mining head into the coal seam. The pushbeam is hydraulically pushed and driven by a large platform based piece of equipment. The pushbeam is typically made of segments which are added one to another as the mining head penetrates and pushes deeper into the mountain. The pushbeams may slide along the floor of the mine or they may have wheels attached. Each segment of the pushbeam typically includes internal augers or other transfer means which ferry the pieces of mined coal internally through pushbeam and out of the mine. Typically, the mining head is designed to move up and down within the coal seam to capture the entirety of the coal seam. Sensors positioned near the mining head help a miner operator determine that the mining head is within the coal seam and not within rock or other material. For instance, measures of specific power draw may indicate that the head is in rock, coal, or looser material. Cameras or other sensors may also be used.

Using such a highwall mining system, the mining head and multiple pushbeams may penetrate more than one thousand feet into a coal seam without the need for a human operator to enter the mine. However, though the use of highwall mining systems may minimize the danger to human life, the use of highwall mining systems does not necessarily minimize the chance of a collapse occurring or the financial risk of such a collapse. Unfortunately it is not uncommon for mines to collapse while highwall mining equipment is positioned within a mine. Further, as highwall mining equipment is expensive, potentially costing several millions of dollars, it is desirable to be able to extract highwall mining equipment from collapsed mines. It is also desirable that the time to extract any mining equipment from a collapsed mine be minimized as downtime for such expensive equipment can quickly increase the detrimental financial impact of a mine collapse.

Under the current state of the art, when a collapse occurs in a highwall mining operation while the highwall mining equipment is located within the mine, there are limited, time consuming, and costly options for proceeding. First, the operators can choose to leave the equipment in the mine and abandon the equipment. Such a course can be wasteful and extremely costly. Second, the operators can attempt to minutely "rock" the pushbeams back and forth using hydraulics of the pusher. That is, they can attempt to push forward a little and then retract a little with hopes of dislodging the mining head and pushbeams. However, as the pushbeams and hydraulics that push them are geared primarily to push and drive into the mountain and not to extract, this process is often unsuccessful and, in any event, time consuming as the hundreds or even a thousand or more feet of pushbeams are moved back and forth by the inch. A third approach is to create another mine directly above the collapsed mine with hopes of opening up the collapse and dislodging the mining equipment. However, as mining is highly regulated by the government and approval must be obtained for each mine, such an approach can be time consuming pending approval by the government. And, in any event, a second collapse may well ensue thus resulting in the loss of a second set of pushbeams and mining heads. A final method is likewise time consuming as it requires approval of the government: sending a human into the mine to inspect the collapse. This method is also disfavored as it places human life in jeopardy and undermines one of the primary benefits of highwall mining, namely that humans need not enter the mine. It is also costly as specialized bracing must be built into the mine for safety purposes before humans may enter.

Thus, there is a need in the art for a mining equipment extraction method and apparatus that preserves the safety of human life and that is time and cost efficient.

Further, under current highwall mining operations, if extraction is attempted via the procedures outlined above, the external equipment must be secured to the ground. Securing is required as there is a tendency for the external equipment to pull towards the highwall once a collapse has occurred and extraction is attempted. However, there are tight governmental regulations which require the external equipment to remain a specified distance, such as twenty feet, from the entrance of the mine. If the equipment moves too close to the mine entrance, human life may be placed in danger and government regulations may be violated. Currently, the practice in the art is to drive large metal rods into the ground to secure equipment. However, this practice can be difficult and costly considering the ground is often solid rock. Further, the driving of the rods may trigger additional collapses. Thus, there is a need in the art for a method of securing the external equipment that keeps the external equipment in place and away from the face of the highwall during extraction of internal mining equipment such as the mining head and pushbeams.

SUMMARY OF THE INVENTION

It is therefore an object of the present invention to provide a mining equipment extraction method and apparatus that preserves the safety of human life and that is time and cost efficient. Such a method and apparatus will not compromise human life and will facilitate quick and inexpensive extraction of mining equipment from collapsed mines.

It is a further object of the present invention to provide a mining equipment extraction method and apparatus that secures external equipment at a specified distance from the highwall face without the need to drive large rods into the rock beneath the external equipment.

These and other objects and advantages of the invention are achieved by providing a mining equipment extraction apparatus and method that facilitates safe and efficient extraction of mining equipment from a collapsed mine. The invention utilizes a pair of remotely operated hydraulic cylinders positioned on the mining head which are also tethered to a pair of cables or wire rope. The cables are securable to the external equipment which is secured from encroachment onto the mountain highwall face by a pair of push plates.

According to one embodiment of the invention, the highwall mining equipment extraction and retrieval apparatus includes a pair of parallel hydraulic cylinders which operate from an extended position to a retracted position. The pair of parallel hydraulic cylinders are attached to either side of a mining head and are also attached to an umbilical cable for remotely powering and actuating the operation of the pair of hydraulic cylinders. The apparatus also includes a pair of parallel wire ropes attached to the pair of parallel hydraulic cylinders. The pair of parallel wire ropes runs along a plurality of pushbeams. The pushbeams are operably attached to the mining head and to an external mining platform. The invention also includes a pair of parallel lockable grip blocks which are attached to the external mining platform and are removably attached to the pair of parallel wire ropes. The pair of parallel lockable grip blocks secures the wire ropes to the mining platform during mining equipment extraction and retrieval. The invention also includes an actuator operably connected to the umbilical cable and to the external mining platform for remotely initiating the actuation of the pair of hydraulic cylinders.

According to another embodiment of the invention the pair of parallel lockable grip blocks each includes a frame having a triangular void. The parallel lockable grip blocks also includes a pair of reciprocal right angle triangular shaped blocks each of which has a semi-cylindrical shaped channel through which the wire rope passes. The radius of the semi-cylindrical shaped channel is less than or equal to a cross-section radius of the wire rope. The pair of reciprocal right angle triangular shaped blocks operates from an unlocked position where the triangular shaped blocks extend from the triangular void and are separated from one another by a first gap to a locked position where the triangular shaped blocks are fully within the triangular void and are separated from one another by a second gap which is smaller than the first gap. The pair of parallel lockable grip blocks also includes a pair of hydraulic cylinders attached to the frame and to the triangular shaped blocks. The pair of hydraulic cylinders of each of the pair of lockable grip blocks actuates the operation of the triangular shaped blocks from the unlocked position to the locked position.

According to another embodiment of the invention each of the plurality of pushbeams includes a channel located on each side of the pushbeam. The wire ropes pass through these channels located on the pushbeams.

According to another embodiment of the invention the pair of parallel lockable grip blocks are manually actuated. However, in another embodiment, the pair of parallel lockable grip blocks are operably connected to the umbilical cable and a single actuation will actuate both the lockable grip blocks and the pair of parallel hydraulic cylinders attached to the mining head. This single actuation simultaneously causes the blocks to operate from the unlocked to the locked position and also causes the pair of parallel hydraulic cylinders of the mining head to operate from the extended position to the retracted position.

According to another embodiment of the invention the highwall mining equipment extraction and retrieval apparatus also includes a pair of stabilizing arms for stabilizing the equipment platform against a highwall face adjacent a mine opening. In such an embodiment, each of the stabilizing arms includes a ramp attached to the external mining platform for guiding pushbeams from the external mining platform and into the mine. Each of the stabilizing arms also includes a pushing plate hingedly attached to the ramp portion for bracing against the side of the highwall adjacent the mine opening and a hydraulic cylinder attached to both the ramp and pushing plate for securing the pushing plate in contact with and Parallel to the highwall.

According to another embodiment of the invention the highwall mining equipment extraction and retrieval apparatus may include a pair of storage spools for storing excess wire rope attached to the external mining platform. Similarly, the highwall mining equipment extraction and retrieval apparatus may include a plurality of sheaves attached to the external mining platform for guiding the wire rope from the storage spools, through the pair of parallel lockable grip blocks, and into the channels of the pushbeams. Further, the highwall mining equipment extraction and retrieval apparatus may include a pair of leaver arms attached to the pair of parallel hydraulic cylinders of the mining head and also attached to the pair of parallel wire ropes. Such leaver arms may provide additional mechanical advantages and may also decrease size requirements for the hydraulic cylinders. Also, in place of or in addition such leaver arms, a series of sheaves or pulleys may be attached to the pair of parallel hydraulic cylinders of the mining head and also attached to the pair of parallel wire ropes. Such sheaves or pulleys may provide additional mechanical advantages and may also decrease size requirements for the hydraulic cylinders.

According to another embodiment, the invention is a method of extracting and retrieving highwall mining equipment from a highwall mine. The method includes the steps of first providing a mine, an external mining platform, a plurality of pushbeams attached to the mining platform and extending into the mine, and a mining head attached to a first pushbeam to enter the mine. Second, providing a pair of parallel hydraulic cylinders remotely operable from an extended to a retracted position and attached to the mining head, a pair of wire ropes running along sides of the pushbeams and attached to the pair of parallel hydraulic cylinders, and a pair of parallel lockable grip blocks attached to the mining platform and removably attached to the pair of wire ropes. Third, determining that an event has occurred which prevents ordinary retraction of mining equipment. Fourth, locking the parallel lockable grip blocks around the pair of wire ropes and remotely operating the pair of parallel hydraulic cylinders from the extended position to the retracted position. Fifth, unlocking the parallel lockable grip blocks from around the pair of wire ropes, operating the hydraulic cylinders from the retracted position to the extended position, and pulling excess wire rope out of the mine and through the lockable grip blocks. Sixth and finally, repeating the previous two steps until the mining head and the pushbeams are clear of any obstruction.

According to another embodiment, the method further provides that the pair of parallel hydraulic cylinders and the pair of parallel lockable grip blocks provided are operably linked by a common actuator that, upon actuation by an operator, remotely and simultaneously locks the pair of parallel lockable grip blocks and retracts the pair of parallel hydraulic cylinders. As desired by the operator, the actuator also remotely and simultaneously unlocks the pair of parallel lockable grip blocks and extends the pair of parallel hydraulic cylinders.

According to another embodiment of the invention, the second step further includes providing a pair of storage spools attached to the external mining platform. The fifth step further includes winding the excess wire rope, which was pulled from the mine, onto the storage spools.

According to another embodiment of the invention, the pushbeams provided in the first step include channels located on respective sides. The pair of wire ropes provided in the second step runs through the respective channels of the pushbeams.

According to another embodiment of the invention the external mining platform provided in the first step further includes a plurality of sheaves attached thereto for guiding the wire rope from the storage spools, through the pair of parallel lockable grip blocks, and into the channels of the pushbeams.

According to another embodiment of the invention the second step also includes providing a pair of stabilizing arms attached to the external mining platform. Each of the stabilizing arms has a ramp, a pusher plate hingedly attached to the ramp, and a hydraulic cylinder attached to the ramp and to the pusher plate. Further, an additional step is inserted between the third step and the fourth step. This additional step includes actuating the hydraulic cylinders of the stabilizing arms until the pusher plates are firmly in contact with a face of highwall mine.

BRIEF DESCRIPTION OF THE DRAWINGS

The present invention is best understood when the following detailed description of the invention is read with reference to the accompanying drawings, in which.

DESCRIPTION OF THE PREFERRED EMBODIMENT AND BEST MODE

Figure 1:
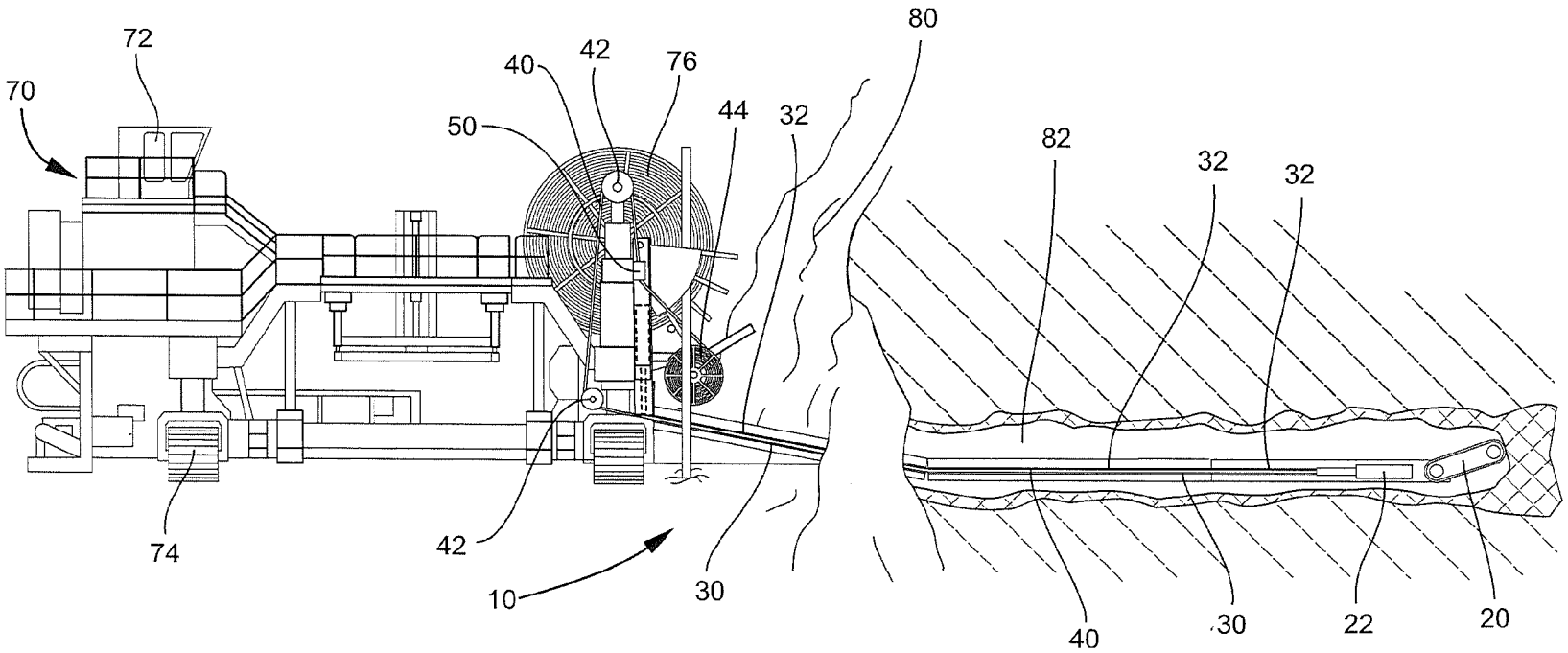
FIG. 1 is a side view of the invention showing a cutaway of a hillside with the pushbeams and cutting head in a mine shaft within the hillside.

Referring now specifically to the drawings, FIG. 1 shows the highwall mining equipment retrieval apparatus 10. An external mining platform 70 is positioned in front of a highwall 80 of a mine 82. The mining platform 70 is large but is movable via attached tracks 74. The external mining platform 70 pushes the mining head 20 via a series of contiguous pushbeams 30 into the mine 82. Power and communication with the mining head 20 from the external platform 70 is achieved by a communication cable and hose which is stored on a large central reel 76. As shown in FIG. 1, the mining head 20 has penetrated the prepared highwall face 80 creating the mine 82 opening. The mining head 20 has further cut into the hill and is mining deeper into the ground. This mine shaft 82 can be seen through the cutaway of the hill revealing the interior of the cut mine 82. As the cutting head 20 penetrates deeper, additional pushbeams 30 are added, one after another. As the cutting head 20 creates debris, such as pieces of coal, the debris is carried internally through the pushbeams 30 and out of the mine 82. The pushbeams 30 are generally rectangular and may be connected one to another as can be seen in FIG. 5.

Figure 3:
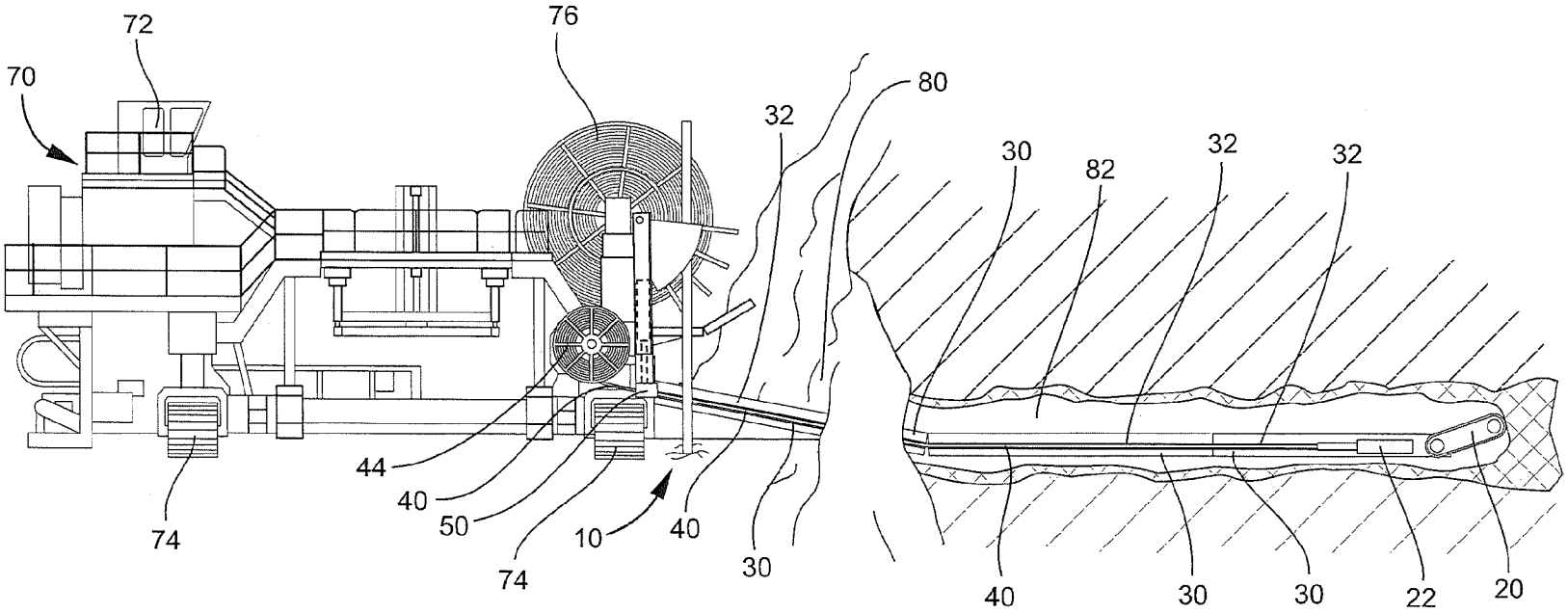
FIG. 3 is a side view of the invention showing a cutaway of a hillside with the pushbeams and cutting head in a mine shaft within the hillside.

FIG. 1 shows a hydraulic cylinder 22 attached near the cutting head 20. The pushbeams 30 are symmetrical and there is another hydraulic cylinder 22 attached on the other, opposite, side of the cutting head 20, parallel to the one shown in FIG. 1. One or more leavers and/or sheaves or pulleys may also be attached between the hydraulic cylinder 20 and the wire rope 40. The wire rope 40 is protected within a channel 32 in the side of the pushbeams 30 and the wire rope 40 extends the length of each of the pushbeams 30 through the entirety of the mine shaft 82 from the cutting head 20 to the external equipment platform 70. Like the hydraulic cylinder 20, there is a channel 32 and wire rope 40 on each side of the pushbeams 30. In the embodiment shown in FIG. 1, the wire ropes 40 on each side of the pushbeams 30 exit the mine shaft 82, pass under a pair of sheaves 42, pass over another pair of sheaves 42, pass through a pair of lockable grip blocks 50, then move onto a pair of storage spools 44. Similar to FIG. 1, FIG. 3 shows an alternate embodiment where when the wire rope 40 exits the mine 82, it first passes through the pair of lockable grip blocks 50 and then it moves onto the storage wheel 44.

Figure 2:
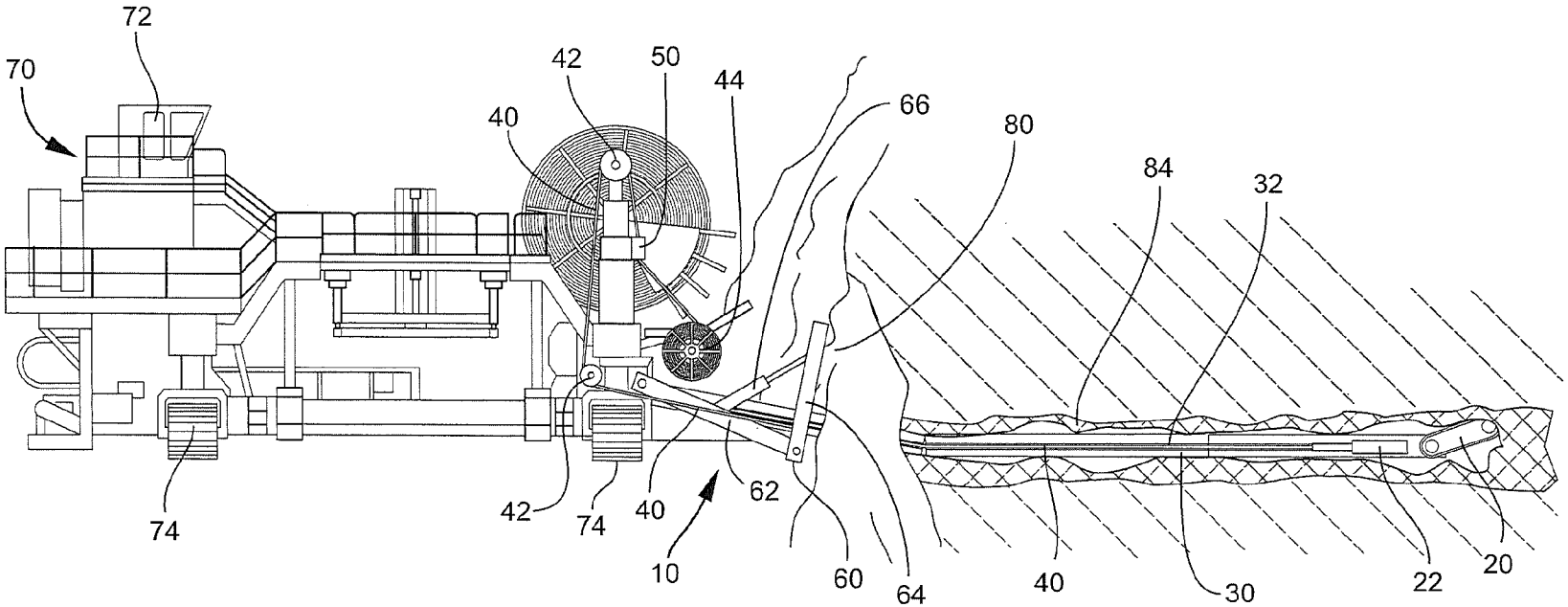
FIG. 2 is a side view of the invention showing a cutaway of a hillside with the pushbeams and cutting head in a mine shaft within the hillside where a collapse has occurred in the mine.
Figure 4:
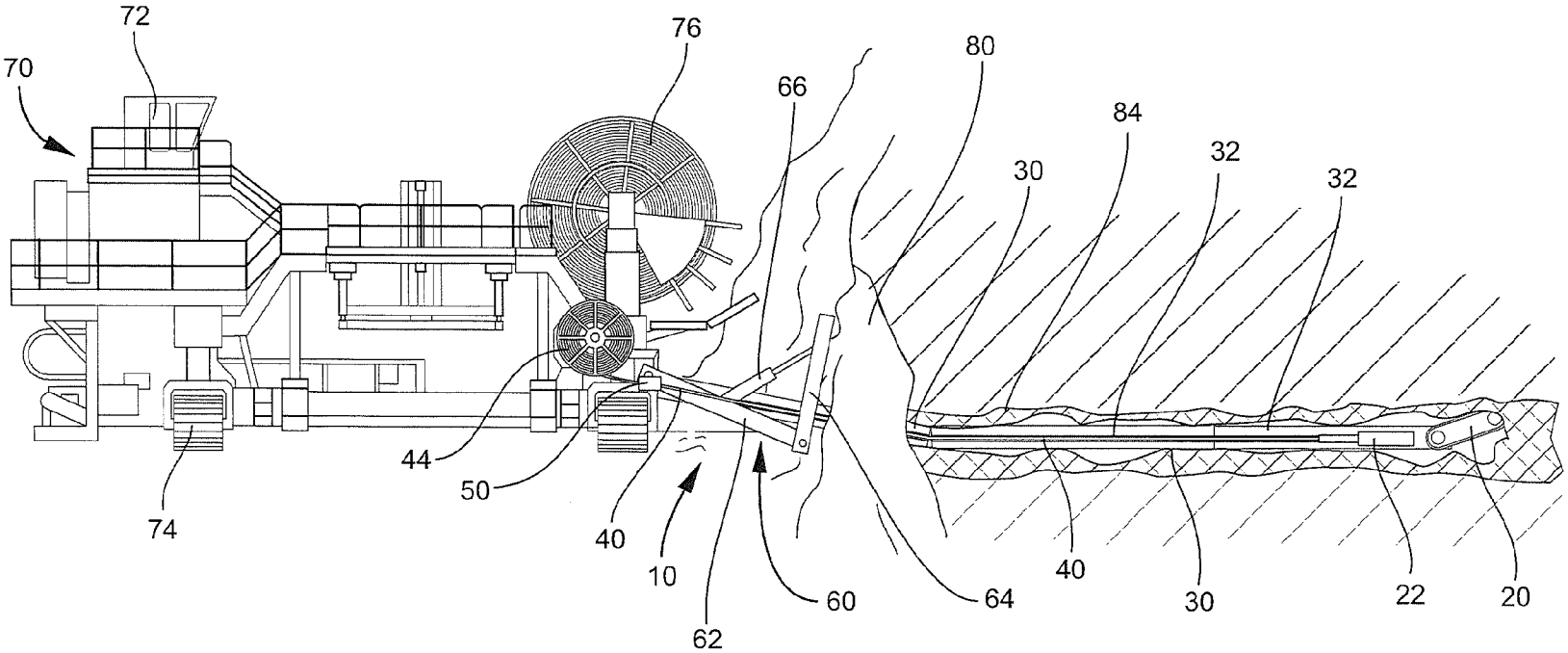
FIG. 4 is a side view of the invention showing a cutaway of a hillside with the pushbeams and cutting head in a mine shaft within the hillside where a collapse has occurred in the mine.

FIG. 2 and FIG. 4 show the use of the stabilizing arms 60 where a mine shaft 82 has suffered a cave-in or collapse 84. The stabilizing arms 60 include a ramp 62, a pusher plate 64 hingedly attached to the ramp 62, and a hydraulic cylinder 66 further linking the pusher plate 64 to the ramp 62. As shown, the pusher plate 64 is in contact with the face 80 of the highwall and is substantially parallel to the face of the high wall 80. The pushbeams 30 slide along and down the ramp 62 and into the mine shaft 82 and when being extracted they slide up the ramp 62. The hydraulic cylinders 66 of the stabilizing arms 60 apply pressure to the face 82 of the highwall so that the external platform 70 is braced against the face 80 of the highwall mine 82. The collapsed mine 84 of FIGS. 2 and 3 show that rock is lodged against the pushbeams 30 and mining head 20 thereby trapping the pushbeams 30 and the mining head 20 within the mine 82. In such a situation of a collapse 82, the apparatus 10 may be deployed to extract the pushbeams 30 and mining head 20. The pair of lockable grip blocks 50 that lock the wire rope 40 in place are actuated to secure the wire rope 40 to the external platform equipment 70. The hydraulic cylinders 22 attached to the mining head 20 move from the extended position to a retracted position, thereby pulling the mining head 20 and pushbeams 30 from the collapsed mine shaft 84. The parallel grip blocks 50 may then be released, the hydraulic cylinders 22 of the mining head 20 moved back to the extended position, and the wire rope 40 that was pulled from the collapsed mine 84 may be stored on the storage spool 44. The pair of lockable grip blocks 50 may again be locked and the process repeated until the mining head 20 and pushbeams 30 are extracted from the collapsed mine shaft 84. Communication with the hydraulic cylinders 22 of mining head 20 may be achieved by providing a communication cable in the cables and hoses stored on the hose reel 76 which operate and power the mining head 20. Such communication with the hydraulic cylinder 220 may allow a person in the control booth 72 to automatically and remotely actuate the hydraulic cylinders 22 of the mining head 20 to dislodge the mining head 20 and the pushbeams 30. Also, the communication with the hydraulic cylinders 22 may further allow the person in the control booth 72 to automatically and remotely actuate both the cylinders 22 and the grip blocks 50 during the process of extraction of the mining head 20 and the pushbeams 30.

Figure 5:
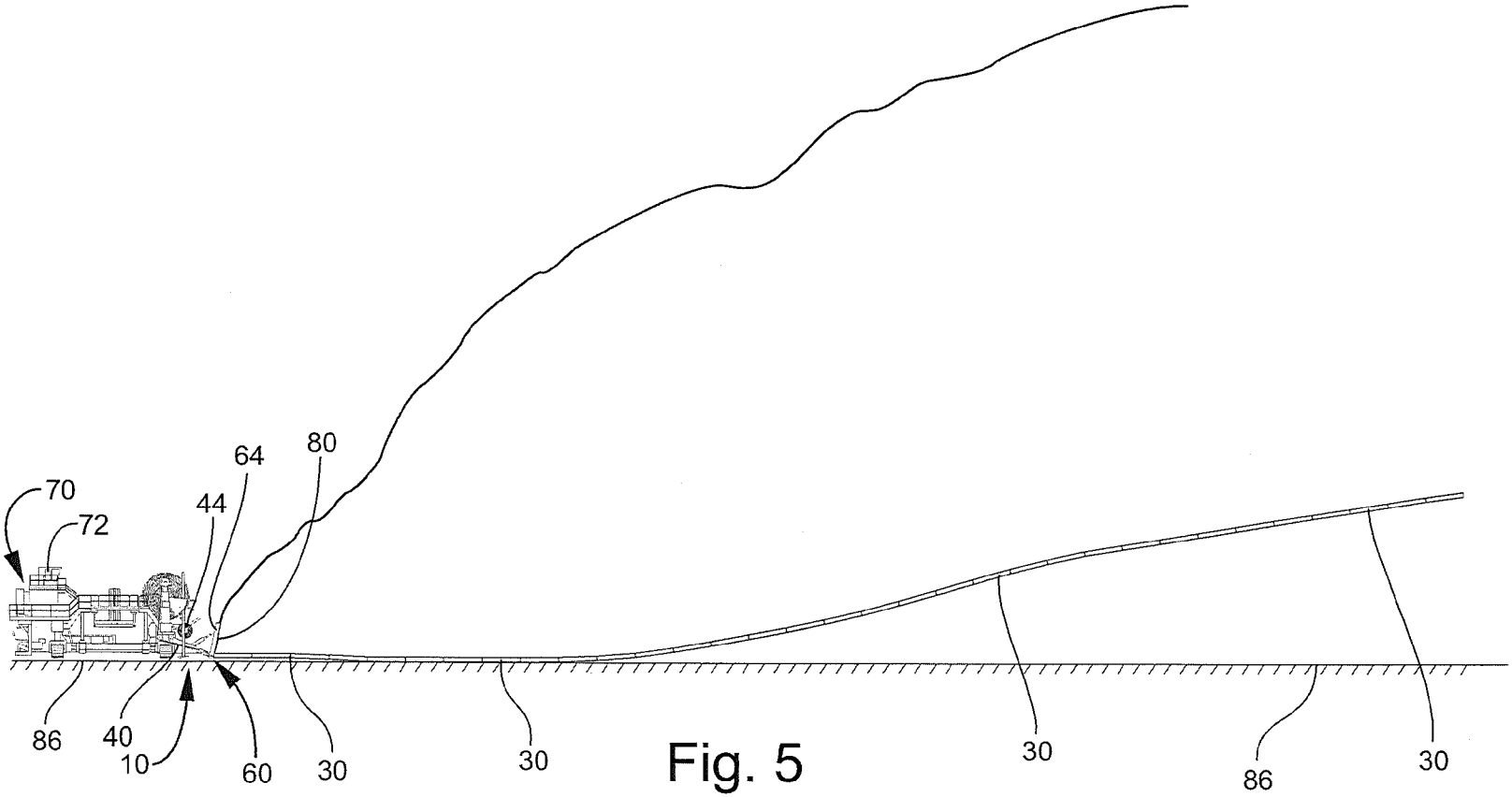
FIG. 5 is a side view of the invention showing a cutaway of a hillside with the pushbeams and cutting head deep into a mine shaft within the hillside.

Referring to FIG. 5, it can be seen that the pushbeams 30 and mining head 20 may penetrate far into the hillside. As also shown in FIG. 5, the mine shaft 82 is not necessarily parallel to level ground 86 outside of the mine shaft 82. The mine shaft 82, as created by the mining head 20 following a seam of coal, may travel up or down relative to the level ground 86 outside the mine shaft 82.

Figure 6:
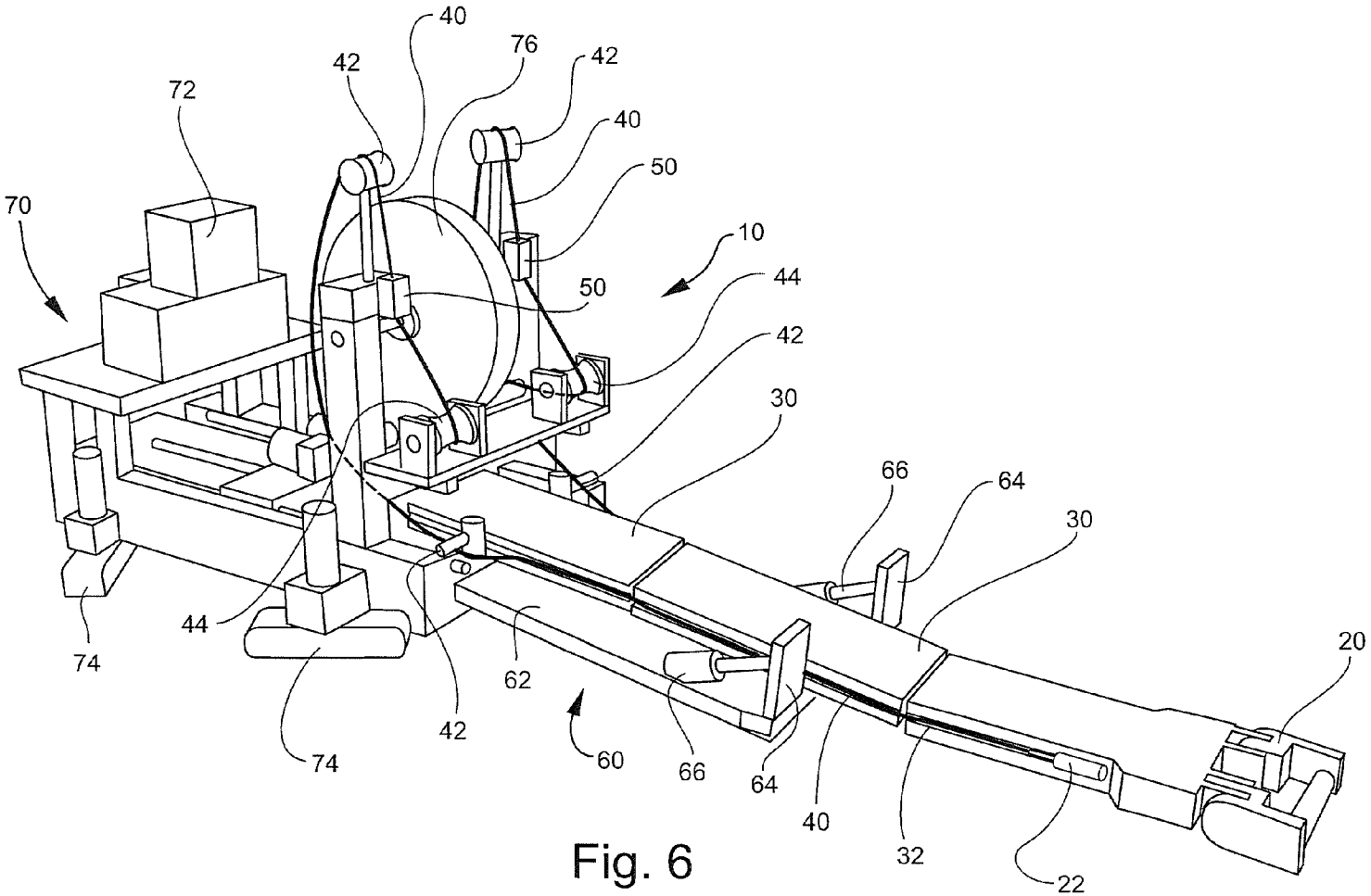
FIG. 6 is a perspective of the invention detached from a highwall and mine.

Referring to FIG. 6, the symmetrical nature of the apparatus 10 can be seen with the parallel sheaves 42, parallel wire ropes 40, and parallel storage spools 44. The parallel elements of the stabilizing arms 60 can also be seen as there are parallel pusher plates 64 and parallel hydraulic cylinders 66. Though not visible from the perspective view of FIG. 6, there are also parallel ramps. FIG. 6 also shows the channels 32 located within the side edges of the pushbeams 30. Though not visible in this perspective view of FIG. 6, the push beams 30 are symmetrical and there are parallel channels 32 on each side. The wire ropes 40 run through these channels 32. Likewise there are parallel hydraulic cylinders 22 located on the mining head 20.

Figure 7:
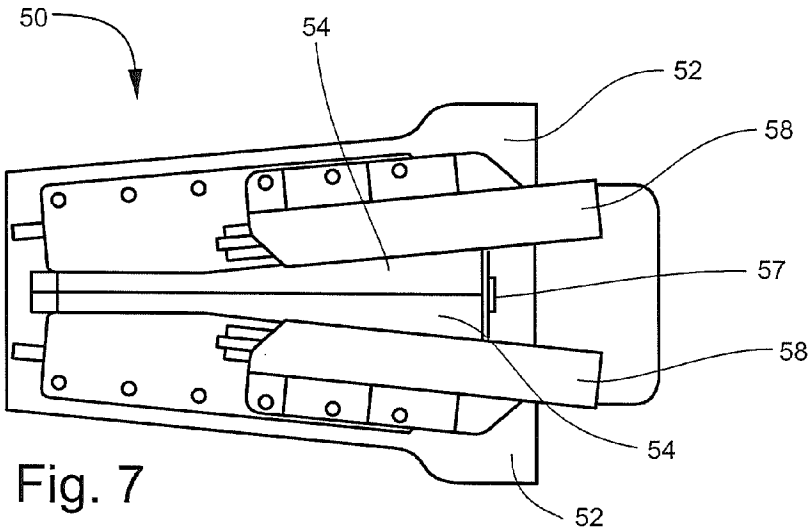
FIG. 7 is a top view of the lockable grip blocks.
Figure 8:
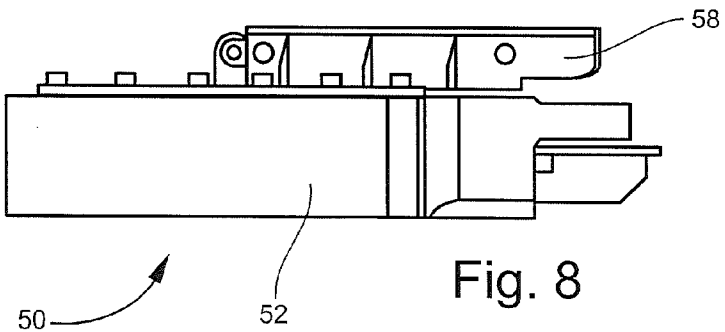
FIG. 8 is a side view of the lockable grip blocks.
Figure 9:
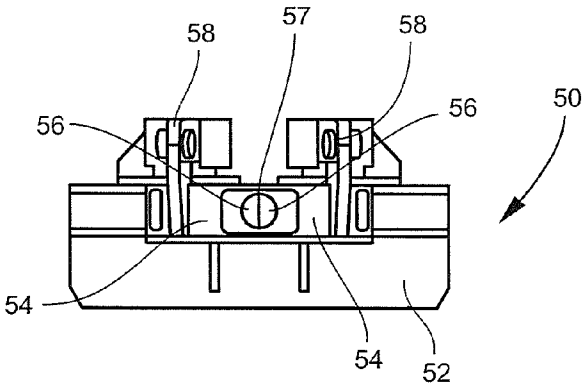
FIG. 9 is an end view of the lockable grip blocks.

As shown in FIG. 6, the invention includes a pair of such lockable grip blocks 50. Referring now to FIGS. 7, 8, and 9, the lockable grip block 50 is shown. The pair of parallel lockable grip blocks 50 each includes a frame 52 having a triangular void. The parallel lockable grip blocks 50 also includes a pair of reciprocal right angle triangular shaped blocks 54 each of which has a semi-cylindrical shaped channel 56 through which the wire rope 40 passes. The radius of the semi-cylindrical shaped channel 56 is less than or equal to a cross-section radius of the wire rope 50. The pair of reciprocal right angle triangular shaped blocks 54 are separated from each other by a gap 57 which is smaller in the locked position and larger in the unlocked position such that the wire rope 40 easily passes through the gap 57 in the unlocked position. The pair of parallel lockable grip blocks 50 also includes a pair of hydraulic cylinders 58 attached to the frame 52 and to the triangular shaped blocks 54. The pair of hydraulic cylinders 58 of each of the pair of lockable grip blocks 50 actuates the operation of the triangular shaped blocks 54 from the unlocked position to the locked position.

A highwall mining equipment retrieval apparatus and method 10 according to the invention has been described with reference to specific embodiments and examples. Various details of the invention may be changed without departing from the scope of the invention. Furthermore, the foregoing description of the preferred embodiments of the invention and best mode for practicing the invention are provided for the purpose of illustration only and not for the purpose of limitation, the invention being defined by the claims.

We claim:

1. A highwall mining equipment extraction and retrieval apparatus comprising:

a. a pair of parallel hydraulic cylinders, operating from an extended position to a retracted position, attached to either side of a mining head and to an umbilical cable for remotely powering and actuating the operation of the pair of hydraulic cylinders;

b. a pair of parallel wire ropes attached to the pair of parallel hydraulic cylinders and running along a plurality of pushbeams, the pushbeams being operably attached to the mining head and to an external mining platform;

c. a pair of parallel lockable grip blocks attached to the external mining platform and removably attached to the pair of parallel wire ropes for securing the wire ropes to the platform during mining equipment extraction and retrieval; and d. an actuator operably connected to the umbilical cable and to the external mining platform for remotely initiating the actuation of the pair of hydraulic cylinders.

2. The highwall mining equipment extraction and retrieval apparatus of claim 1 wherein the pair of parallel lockable grip blocks each comprise a frame having a triangular void; a pair of reciprocal right angle triangular shaped blocks each having a semi-cylindrical shaped channel through which the wire rope passes, of a radius less than or equal to a cross-section radius of the wire rope, and operating from an unlocked position where the triangular shaped blocks extend from the triangular void and are separated from one another by a first gap to a locked position where the triangular shaped blocks are fully within the triangular void and are separated from one another by a second gap which is smaller than the first gap; and a pair of hydraulic cylinders attached to the frame and to the triangular shaped blocks and actuating the operation of the triangular shaped blocks from the unlocked position to the locked position.

3. The highwall mining equipment extraction and retrieval apparatus of claim 2 wherein each of the plurality of pushbeams further comprises a channel located on each side of the pushbeam and wherein the wire ropes pass through the channels of the pushbeams.

4. The highwall mining equipment extraction and retrieval apparatus of claim 3 wherein the pair of parallel lockable grip blocks are manually actuated.

5. The highwall mining equipment extraction and retrieval apparatus of claim 3 wherein the pair of parallel lockable grip blocks are operably connected to the umbilical cable and a single actuation will actuate both the lockable grip blocks and the pair of parallel hydraulic cylinders attached to the mining head, the single actuation simultaneously causing the blocks to operate from the unlocked to the locked position and the pair of parallel hydraulic cylinders of the mining head to operate from the extended position to the retracted position.

6. The highwall mining equipment extraction and retrieval apparatus of claim 1 further comprising a pair of stabilizing arms for stabilizing the equipment platform against a highwall face adjacent a mine opening, each of the stabilizing arms comprising a ramp attached to the external mining platform for guiding pushbeams from the external mining platform and into the mine, a pushing plate hingedly attached to the ramp for bracing against the side of the highwall adjacent the mine opening, and a hydraulic cylinder attached to both the ramp and pushing plate for securing the pushing plate in contact with and parallel to the highwall.

7. The highwall mining equipment extraction and retrieval apparatus of claim 2 further comprising a pair of storage spools for storing excess wire rope attached to the external mining platform.

8. The highwall mining equipment extraction and retrieval apparatus of claim 7 further comprising a plurality of sheaves attached to the external mining platform for guiding the wire rope from the storage spools, through the pair of parallel lockable grip blocks, and into the channels of the pushbeams.

9. The highwall mining equipment extraction and retrieval apparatus of claim 1 further comprising a pair of leaver arms attached to the pair of parallel hydraulic cylinders of the mining head and also attached to the pair of parallel wire ropes.

10. A highwall mining equipment extraction and retrieval apparatus comprising:

a. a pair of parallel hydraulic cylinders, operating from an extended position to a retracted position, attached to either side of a mining head and to an umbilical cable for remotely powering and actuating the operation of the pair of hydraulic cylinders;

b. a pair of parallel wire ropes attached to the pair of parallel hydraulic cylinders and running along a plurality of pushbeams, the pushbeams being operably attached to the mining head and to an external mining platform;

c. a pair of parallel lockable grip blocks attached to the external mining platform, each of the lockable grip blocks comprising a frame having a triangular void, a pair of reciprocal right angle triangular shaped blocks each having a semi-cylindrical shaped channel through which the wire rope passes, of a radius less than or equal to a cross-section radius of the wire rope, and operating from an unlocked position where the triangular shaped blocks extend from the triangular void and are separated from one another by a first gap to a locked position where the triangular shaped blocks are fully within the triangular void and are separated from one another by a second gap which is smaller than the first gap, and a pair of hydraulic cylinders attached to the frame and to the triangular shaped blocks and actuating the operation of the triangular shaped blocks from the unlocked position to the locked position;

d. an actuator operably connected to the umbilical cable and to the external mining platform for remotely initiating the actuation of the pair of hydraulic cylinders; and e. a pair of stabilizing arms for stabilizing the equipment platform against a highwall face adjacent a mine opening, each of the stabilizing arms comprising a ramp attached to the external mining platform for guiding pushbeam segments from the external mining platform and into the mine, a pushing plate hingedly attached to the ramp for bracing against the side of the highwall adjacent the mine opening, and a hydraulic cylinder attached to both the ramp and pushing plate for securing the pushing plate in contact with and parallel to the highwall.

11. The highwall mining equipment extraction and retrieval apparatus of claim 10 further comprising: a channel disposed on each side of the pushbeam for the passage of the wire rope; a pair of storage spools for storing excess wire rope attached the external mining platform; and a plurality of sheaves for guiding the wire rope from the storage spools, through the pair of parallel lockable grip blocks, and into the channels of the pushbeams.

12. The highwall mining equipment extraction and retrieval apparatus of claim 11 wherein the pair of parallel lockable grip blocks are manually actuated.

13. The highwall mining equipment extraction and retrieval apparatus of claim 11 wherein the pair of parallel lockable grip blocks are operably connected to the umbilical cable and a single actuation will actuate both the lockable grip blocks and the pair of parallel hydraulic cylinders attached to the mining head, the single actuation simultaneously causing the blocks to operate from the unlocked to the locked position and the pair of parallel hydraulic cylinders to operate from the extended position to the retracted position.

14. A method of extracting and retrieving highwall mining equipment from a highwall mine comprising the steps of:

a. providing a mine, an external mining platform, a plurality of pushbeams attached to the mining platform and extending into the mine, and a mining head attached to a first pushbeam to enter the mine;

b. providing a pair of parallel hydraulic cylinders remotely operable from an extended to a retracted position and attached to the mining head, a pair of wire ropes running along sides of the pushbeams and attached to the pair of parallel hydraulic cylinders, and a pair of parallel lockable grip blocks attached to the mining platform and removably attached to the pair of wire ropes;

c. determining that an event has occurred which prevents ordinary retraction of mining equipment;

d. locking the parallel lockable grip blocks around the pair of wire ropes and remotely operating the pair of parallel hydraulic cylinders from the extended position to the retracted position;

e. unlocking the parallel lockable grip blocks from around the pair of wire ropes, operating the hydraulic cylinders from the retracted position to the extended position, and pulling excess wire rope out of the mine and through the lockable grip blocks;

f. repeating steps d and e until the mining head and the pushbeams are clear of any obstruction.

15. The method of extracting and retrieving highwall mining equipment from a highwall mine of claim 14 wherein the pair of parallel hydraulic cylinders and the pair of parallel lockable grip blocks provided in step b are operably linked by a common actuator that remotely and simultaneously locks the pair of parallel lockable grip blocks and retracts the pair of parallel hydraulic cylinders and also remotely and simultaneously unlocks the pair of parallel lockable grip blocks and extends the pair of parallel hydraulic cylinders.

16. The method of extracting and retrieving highwall mining equipment from a highwall mine of claim 15 wherein step b further comprises providing a pair of storage spools attached to the external mining platform and step e further comprises winding the excess wire rope onto the storage spools.

17. The method of extracting and retrieving highwall mining equipment from a highwall mine of claim 16 wherein the pushbeams provided in step a include channels located on respective sides and wherein the pair of wire ropes provided in step b runs through the respective channels of the pushbeams.

18. The method of extracting and retrieving highwall mining equipment from a highwall mine of claim 17 wherein the external mining platform provided in step a further comprises a plurality of sheaves attached to the external mining platform for guiding the wire rope from the storage spools, through the pair of parallel lockable grip blocks, and into the channels of the pushbeams.

19. The method of extracting and retrieving highwall mining equipment from a highwall mine of claim 14 wherein step b further comprises providing a pair of stabilizing arms attached to the external mining platform each having a ramp, a pusher plate hingedly attached to the pusher plate, and a hydraulic cylinder attached to the ramp and to the pusher plate and wherein a step c1 is inserted between step c and d, step c1 comprising actuating the hydraulic cylinders of the stabilizing arms until the pusher plates are firmly in contact with a face of highwall mine.

20. The method of extracting and retrieving highwall mining equipment from a highwall mine of claim 18 wherein step b further comprises providing a pair of stabilizing arms attached to the external mining platform each having a ramp, a pusher plate hingedly attached to the pusher plate, and a hydraulic cylinder attached to the ramp and to the pusher plate and wherein a step c1 is inserted between step c and d, step c1 comprising actuating the hydraulic cylinders of the stabilizing arms until the pusher plates are firmly in contact with a face of highwall mine.

* * * * *

UNITED STATES PATENT AND TRADEMARK OFFICE

CERTIFICATE OF CORRECTION

PATENT NO. : 8,857,916 B2
APPLICATION NO. : 13/841090
DATED : October 14, 2014
INVENTOR(S) : Whitley et al.

It is certified that error appears in the above-identified patent and that said Letters Patent is hereby corrected as shown below:

On Title Page:
Item (71), Applicant:
Please correct "Highwall Mining Solutions and Repair, LLC, Summersville, WV (US)"
to read -- Highwall Mining Innovations, LLC, Summersville, WV (US) --

Signed and Sealed this
Twenty-seventh Day of October, 2015

Michelle K. Lee

Michelle K. Lee
*Director of the United States Patent and Trademark Office*